US009365374B2

(12) United States Patent
Yoshii et al.

(10) Patent No.: US 9,365,374 B2
(45) Date of Patent: Jun. 14, 2016

(54) SHEET TRANSPORT DEVICE AND IMAGE FORMING SYSTEM

(71) Applicant: FUJI XEROX CO., LTD., Tokyo (JP)

(72) Inventors: Hajime Yoshii, Kanagawa (JP); Nooun Lee, Kanagawa (JP); Inho Kang, Kanagawa (JP); Taeil Byeon, Kanagawa (JP); Woojin Ha, Kanagawa (JP); Jeman Shin, Kanagawa (JP); Hyunsu Shin, Kanagawa (JP); Yongho Choi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/726,738

(22) Filed: Jun. 1, 2015

(65) Prior Publication Data

US 2016/0122145 A1 May 5, 2016

(30) Foreign Application Priority Data

Nov. 4, 2014 (JP) ..... 2014-224122

(51) Int. Cl.

| | |
|---|---|
| ***B65H 5/34*** | (2006.01) |
| ***B65H 7/06*** | (2006.01) |
| ***B65H 5/06*** | (2006.01) |
| ***B65H 5/26*** | (2006.01) |
| ***B65H 9/00*** | (2006.01) |
| ***B65H 7/02*** | (2006.01) |

(52) U.S. Cl.

CPC ..... *B65H 5/34* (2013.01); *B65H 5/068* (2013.01); *B65H 5/26* (2013.01); *B65H 7/02* (2013.01); *B65H 7/06* (2013.01); *B65H 9/002* (2013.01); *B65H 9/006* (2013.01); *B65H 2404/7231* (2013.01)

(58) Field of Classification Search

CPC ..... B65H 5/34; B65H 9/006; B65H 9/002; B65H 5/062; B65H 5/068; B65H 7/02; B65H 7/14; B65H 2404/7231; B65H 2513/104

See application file for complete search history.

(56) References Cited

U.S. PATENT DOCUMENTS

| | | | | |
|---|---|---|---|---|
| 6,092,803 A * | 7/2000 | Munenaka | ..... | B65H 9/103 271/242 |
| 6,530,569 B2 * | 3/2003 | Yamagishi | ..... | B65H 5/062 271/270 |

FOREIGN PATENT DOCUMENTS

JP 2004-323150 A 11/2004

* cited by examiner

*Primary Examiner* — Luis A Gonzalez

(74) *Attorney, Agent, or Firm* — Sughrue Mion, PLLC

(57) ABSTRACT

A sheet transport device includes first to third rotating members, a sheet position detector, and a controller. The first member transports a sheet at a first speed. The second member transports the sheet at a second speed that is lower than the first speed. The third member in a stopped state receives the sheet and subsequently resumes transporting to perform positional correction thereon. The detector detects positions of leading and trailing edges of the sheet. The controller performs control such that, when a preset time elapses after the detector detects that the leading edge has reached the third member, the third member is caused to resume transporting at the second speed, and when the detector detects that the leading edge has passed the second member, the third member is increased in speed from the second speed to the first speed.

8 Claims, 16 Drawing Sheets

SHEET TRANSPORT DEVICE AND IMAGE FORMING SYSTEM

CROSS-REFERENCE TO RELATED APPLICATIONS

This application is based on and claims priority under 35 USC 119 from Japanese Patent Application No. 2014-224122 filed Nov. 4, 2014.

BACKGROUND

Technical Field

The present invention relates to sheet transport devices and image forming systems.

SUMMARY

Sheet Transport Device

According to an aspect of the invention, there is provided a sheet transport device including a first rotating member, a second rotating member, a third rotating member, a sheet position detector, and a controller. The first rotating member transports a sheet at a first transport speed. The second rotating member is provided upstream of the first rotating member in a sheet transport direction and transports the sheet at a second transport speed, which is lower than the first transport speed. The third rotating member is provided upstream of the second rotating member in the sheet transport direction. The third rotating member in a stopped state receives the transported sheet and subsequently resumes transporting the sheet so as to perform positional correction on the sheet. The sheet position detector detects positions of a leading edge and a trailing edge of the transported sheet. The controller performs control such that, when a preset time elapses after the sheet position detector detects that the leading edge of the sheet has reached the third rotating member, the third rotating member is caused to resume transporting the sheet at the second transport speed, and when the sheet position detector detects that the leading edge of the sheet has passed the second rotating member, the third rotating member is increased in transport speed from the second transport speed to the first transport speed.

BRIEF DESCRIPTION OF THE DRAWINGS

Exemplary embodiments of the present invention will be described in detail based on the following figures, wherein.

DETAILED DESCRIPTION

An exemplary embodiment of the present invention will now be described in detail with reference to the drawings.

First, an image forming system that performs printing on a large number of sheets will be described with reference to FIG. 1.

Figure 1:
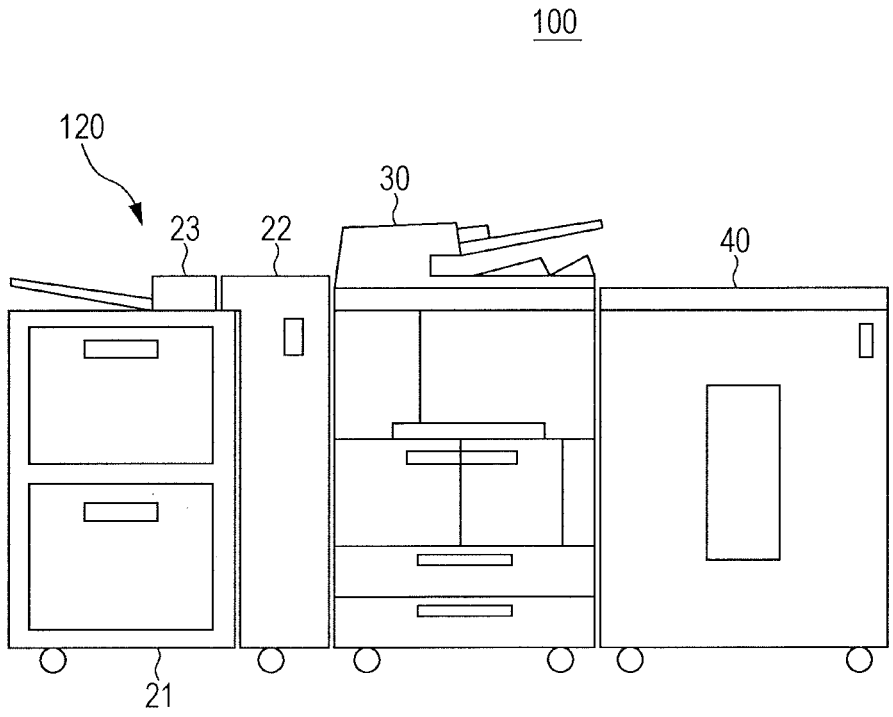
FIG. 1 illustrates the configuration of an image forming system that performs printing on a large number of sheets.

An image forming system 100 shown in FIG. 1 includes a large-capacity sheet feed apparatus 120, an image forming apparatus 30, and a large-capacity stacker 40.

The image forming apparatus 30 receives print data transmitted from, for example, a terminal apparatus (not shown) and outputs an image according to the print data onto a sheet. The image forming apparatus 30 is a so-called multifunction apparatus having multiple functions, such as a printing function, a scanning function, a copying function, and a facsimile function.

The large-capacity sheet feed apparatus 120 includes a two-level sheet feed tray 21, a connection transport unit 22, and a manual feed tray unit 23.

The connection transport unit 22 is connected to a part of the image forming apparatus 30 where a manual feed tray is provided and feeds a printing sheet to the image forming apparatus 30.

The two-level sheet feed tray 21 has trays that are disposed in a two-level configuration and that store a large number of printing sheets to be fed. A printing sheet from each tray is fed to the image forming apparatus 30 via the connection transport unit 22. The manual feed tray unit 23 is connected to the connection transport unit 22 and is used for manually feeding a sheet.

The image forming apparatus 30 forms an image onto a sheet transported by the large-capacity sheet feed apparatus 120. Then, the large-capacity stacker 40 stocks the sheet that has undergone the printing performed by the image forming apparatus 30.

With this configuration, the image forming system 100 shown in FIG. 1 is capable of successively performing printing on a large number of printing sheets.

Figure 2:
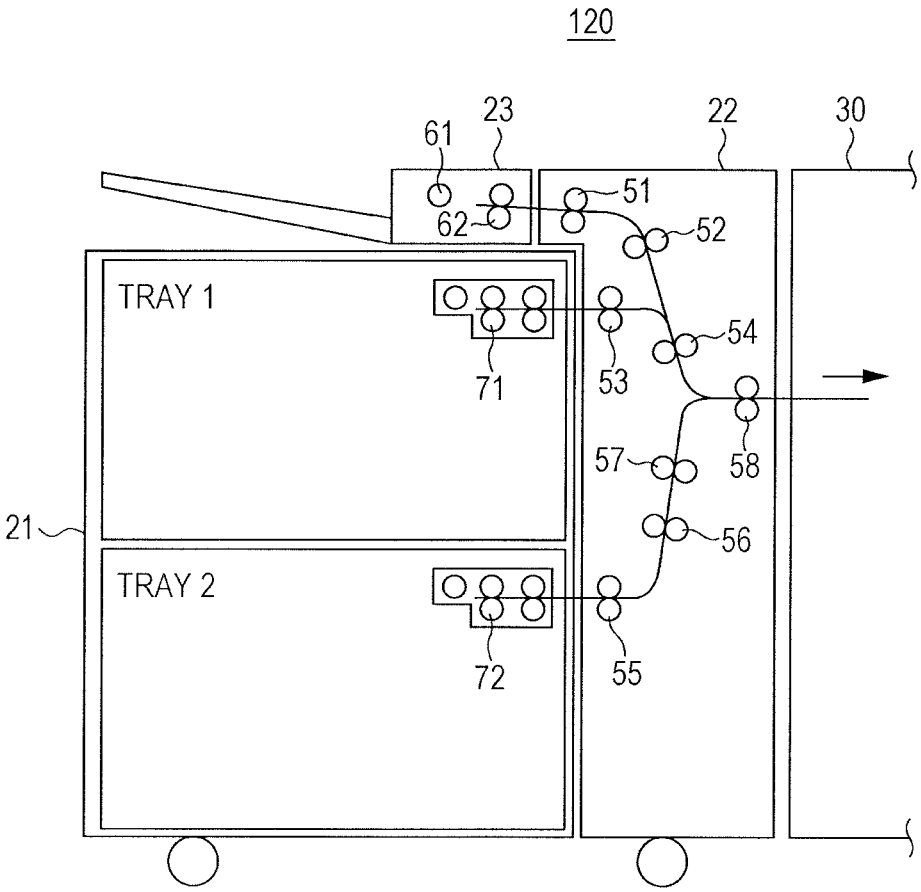
FIG. 2 illustrates a sheet transport path in a large-capacity sheet feed apparatus shown in FIG. 1.

Next, a sheet transport path in the large-capacity sheet feed apparatus 120 shown in FIG. 1 will be described with reference to FIG. 2.

The two-level sheet feed tray 21 is constituted of trays 1 and 2 that respectively include transport roller groups 71 and 72 for feeding the stored printing sheets in a one-by-one fashion. Although each of the transport roller groups 71 and 72 includes, for example, a feed roller and a retardation roller, descriptions thereof will be omitted.

The manual feed tray unit 23 is provided with transport rollers 61 and 62 for transporting a sheet placed on a manual feed tray.

The connection transport unit 22 is provided with transport rollers 51 to 58 for transporting a sheet from the manual feed tray unit 23 and sheets fed from the trays 1 and 2 to the image forming apparatus 30. As is apparent from FIG. 2, although each of the transport rollers 51 to 58 is constituted of two rollers as a pair provided above and below the sheet transport path, each pair of rollers will be referred as a roller in the following description.

In the large-capacity sheet feed apparatus 120, the basic sheet transport speed is set to 1100 mm/s. However, in the manual feed tray unit 23, the sheet transport speed is set to 727 mm/s since it is somewhat difficult to set the speed for pulling a sheet from the manual feed tray to a high value.

Since the transport speed is different between the manual feed tray unit 23 and the connection transport unit 22, the transport speed of the transport roller 51 in the connection transport unit 22, which receives a sheet from the manual feed tray unit 23, is set to 727 mm/s, and the transport speed of the subsequent transport roller 52 is set to 1100 mm/s.

With this configuration, a sheet transported from the manual feed tray unit 23 is received by the transport roller 51 at the sheet transport speed of 727 mm/s. Subsequently, the sheet transport speed is increased to 1100 mm/s by the transport roller 52. Then, the sheet merges into the sheet transport path extending from the trays 1 and 2.

Figure 3:
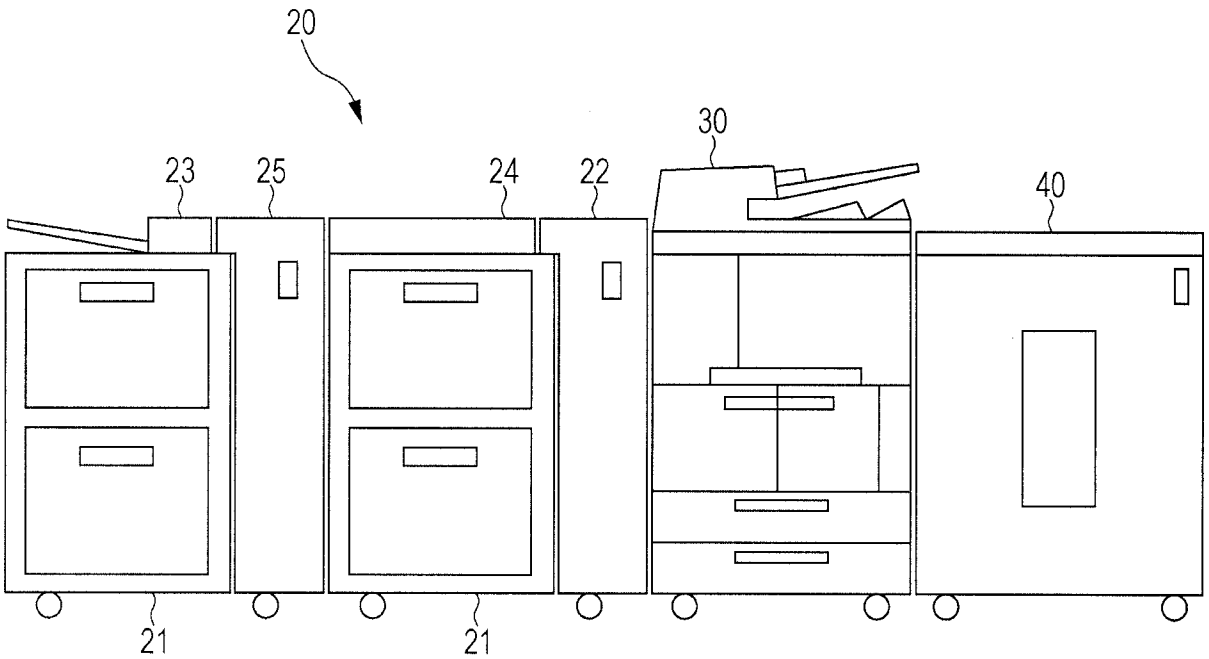
FIG. 3 illustrates a system configuration of an image forming system according to an exemplary embodiment of the present invention.
Figure 4:
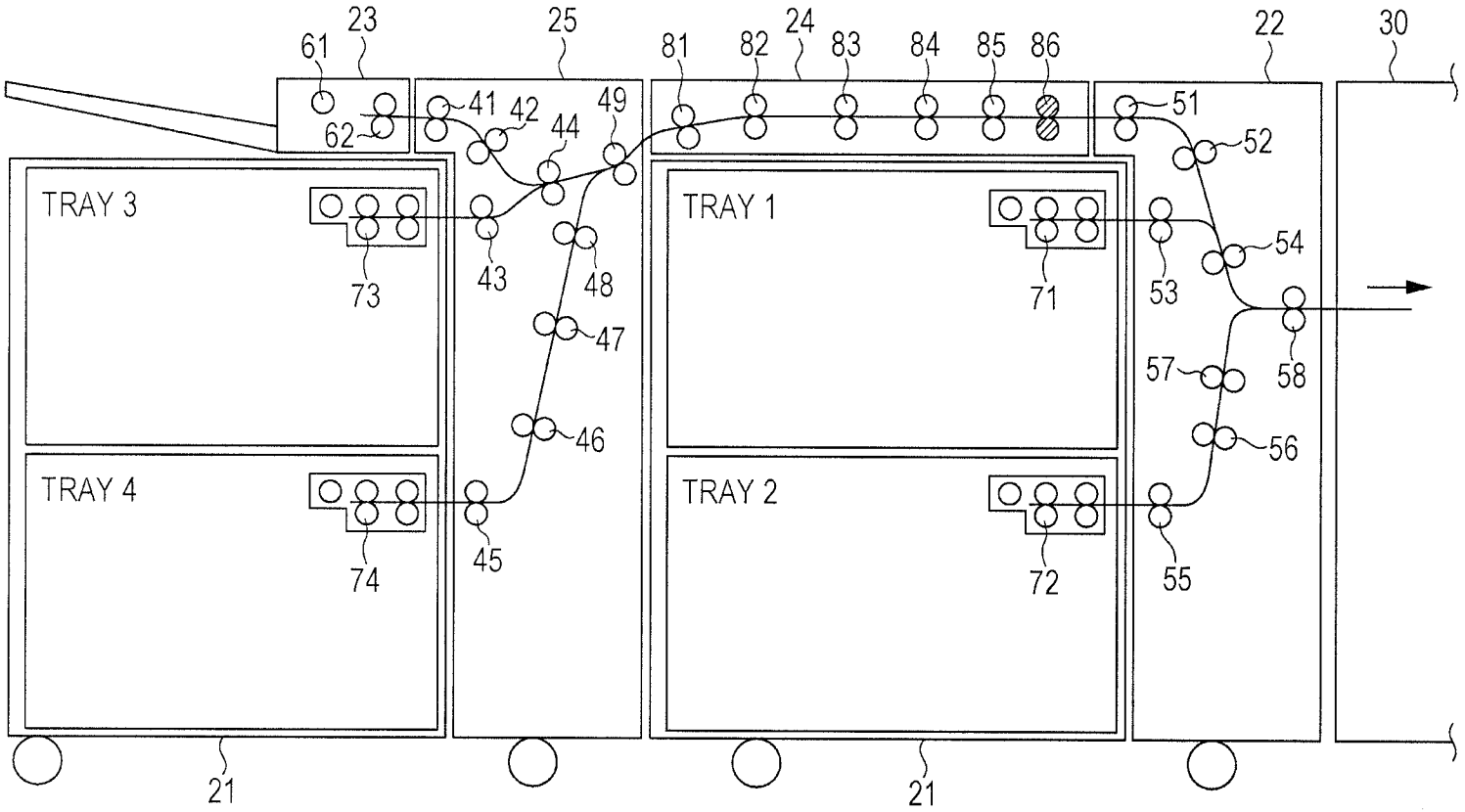
FIG. 4 illustrates a sheet transport path in a large-capacity sheet feed apparatus shown in FIG. 3.

FIG. 3 illustrates a system configuration of an image forming system 10 according to an exemplary embodiment of the present invention. FIG. 4 illustrates a sheet transport path in a large-capacity sheet feed apparatus 20 shown in FIG. 3. In FIGS. 3 and 4, components similar to the components in FIGS. 1 and 2 are given the same reference characters, and descriptions thereof will be omitted.

The image forming system 10 according to this exemplary embodiment has a configuration in which the large-capacity sheet feed apparatus 120 in the image forming system 10 shown in FIG. 1 has been replaced with the large-capacity sheet feed apparatus 20.

The large-capacity sheet feed apparatus 20 according to this exemplary embodiment is capable of feeding a larger number of printing sheets than the large-capacity sheet feed apparatus 120 shown in FIG. 1 and has two two-level sheet feed trays 21 connected to each other.

As shown in FIG. 3, the large-capacity sheet feed apparatus 20 according to this exemplary embodiment includes two two-level sheet feed trays 21, a connection transport unit 22, a manual feed tray unit 23, a flat transport unit (sheet transport device) 24, and an intermediate transport unit 25.

The large-capacity sheet feed apparatus 20 according to this exemplary embodiment is obtained by attaching the flat transport unit 24 in place of the manual feed tray unit 23 to the large-capacity sheet feed apparatus 120 shown in FIG. 1, attaching the intermediate transport unit 25 to the second two-level sheet feed tray 21, and then connecting the intermediate transport unit 25 to the flat transport unit 24. Then, the manual feed tray unit 23 is connected to the intermediate transport unit 25.

Next, a sheet transport path in the large-capacity sheet feed apparatus 20 shown in FIG. 3 will be described with reference to FIG. 4.

The second two-level sheet feed trays 21 that has been added in this exemplary embodiment is constituted of trays 3 and 4 that respectively include transport roller groups 73 and 74 for feeding stored printing sheets in a one-by-one fashion.

The intermediate transport unit 25 is provided with transport rollers 41 to 49 for transporting a sheet from the manual feed tray unit 23 and sheets fed from the trays 3 and 4 to the flat transport unit 24.

The flat transport unit 24 includes transport rollers 81 to 84, a preregistration roller 85, and a registration roller 86. The preregistration roller 85 is a transport roller disposed immediately in front of the registration roller 86.

The transport rollers 81 to 84 and the preregistration roller 85 sequentially transport a sheet transported from the intermediate transport unit 25 toward the registration roller 86.

The preregistration roller 85 is provided for reducing the transport speed of a sheet that is to be brought into abutment with the registration roller 86.

The registration roller 86, in its stopped state, receives the leading edge of a transported sheet so as to correct skewing of the transported sheet. Although a registration roller provided within the image forming apparatus 30 is used for synchronizing the sheet transport timing with the image formation timing, the registration roller 86 in this exemplary embodiment is not used for such a purpose since it is provided within the large-capacity sheet feed apparatus 20.

In the large-capacity sheet feed apparatus 20 according to this exemplary embodiment, the sheet transport path is long and thus tends to cause a sheet to skew readily. Therefore, the registration roller 86 is provided for correcting such skewing.

With this configuration, the flat transport unit 24 transports a sheet transported from the intermediate transport unit 25 to the connection transport unit 22.

Figure 5:
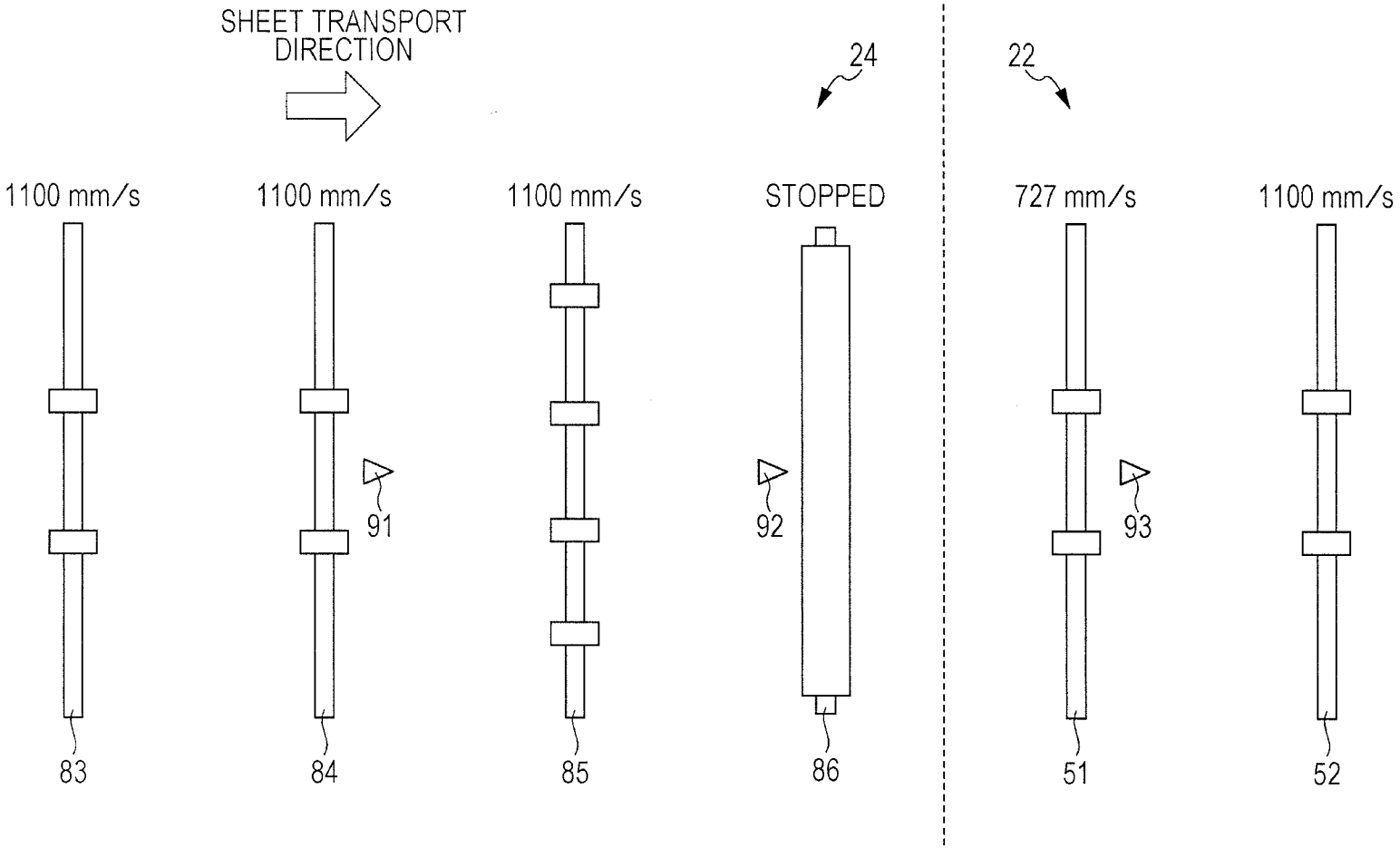
FIG. 5 illustrates transport rollers located in an area where a flat transport unit and a connection transport unit shown in FIG. 3 are connected to each other, as viewed from above.

FIG. 5 illustrates the transport rollers located in an area where the flat transport unit 24 and the connection transport unit 22 are connected to each other, as viewed from above.

In FIG. 5, the transport rollers 83 and 84, the preregistration roller 85, and the registration roller 86 of the flat transport unit 24 and the transport rollers 51 and 52 of the connection transport unit 22 are shown.

Since the standard transport speed in the sheet transport path is 1100 mm/s, the transport rollers 83 and 84, the preregistration roller 85, and the transport roller 52 normally transport a sheet at the transport speed of 1100 mm/s. However, the transport speed of the transport roller 51 is 727 mm/s, which is lower than the transport speed of the transport roller 52 and so on.

The transport roller 52 is a rotating member (first rotating member) that transports a sheet at a transport speed of 1100 mm/s (first transport speed). The transport roller 51 is a rotating member (second rotating member) that is provided upstream of the transport roller 52 in the sheet transport direction and that transports a sheet at a transport speed of 727 mm/s (second transport speed), which is lower than the transport speed of 1100 mm/s.

The registration roller 86 is a rotating member (third rotating member) that is provided upstream of the transport roller 51 in the sheet transport direction and that receives, in its stopped state, a transported sheet and subsequently resumes transporting the sheet so as to perform positional correction on the sheet.

The registration roller 86 is formed by attaching a tubular roller around a rotation shaft and is configured to come into contact with a transported sheet continuously in the sheet width direction so as to perform positional correction on the sheet. On the other hand, the transport roller 52 has two transport roller bearings attached to a rotation shaft so as to partially come into contact with a transported sheet in the sheet width direction.

Therefore, the area that the registration roller 86 comes into contact with a transported sheet in the sheet width direction is larger than the area that the transport roller 52 comes into contact with the sheet in the sheet width direction.

The transport rollers 83 and 84 are rotating members (fourth rotating members) that are provided upstream of the registration roller 86 in the sheet transport direction and that transport a sheet at a transport speed of 1100 mm/s.

Similar to the transport roller 52, the transport rollers 83 and 84 each have two transport roller bearings attached to a rotation shaft so as to partially come into contact with a transported sheet in the sheet width direction.

Therefore, the area that the registration roller 86 comes into contact with a transported sheet in the sheet width direction is larger than the area that each of the transport rollers 83 and 84 comes into contact with the sheet in the sheet width direction.

When using two or more connected two-level sheet feed trays 21, if the transport speed of the transport roller 51 is to be changed from 727 mm/s to 1100 mm/s, for example, a gear or a pulley used in a driver for the transport roller 51 may have to be changed, which may lead to an increase in cost as well as an increase in time spent when recombining the devices. Furthermore, if the driver is designed such that the transport speed is non-switchable, the transport speed is non-changeable in the first place. Therefore, in this exemplary embodiment, the transport speed of the transport roller 51 is fixed at 727 mm/s.

In FIG. 5, the positions where sheet-position detection sensors (sheet position detectors) 91 to 93 that detect the position of the leading edge of a transported sheet are shown. In the large-capacity sheet feed apparatus 20 according to this exemplary embodiment, the various types of transport rollers are controlled by using these sheet-position detection sensors 91 to 93 to detect the leading-edge position and the trailing-edge position of a transported sheet.

In the large-capacity sheet feed apparatus 20 according to this exemplary embodiment, there are many sheet-position detection sensors provided in addition to the sheet-position detection sensors 91 to 93. However, descriptions of these sheet-position detection sensors will be omitted below.

Figure 6:
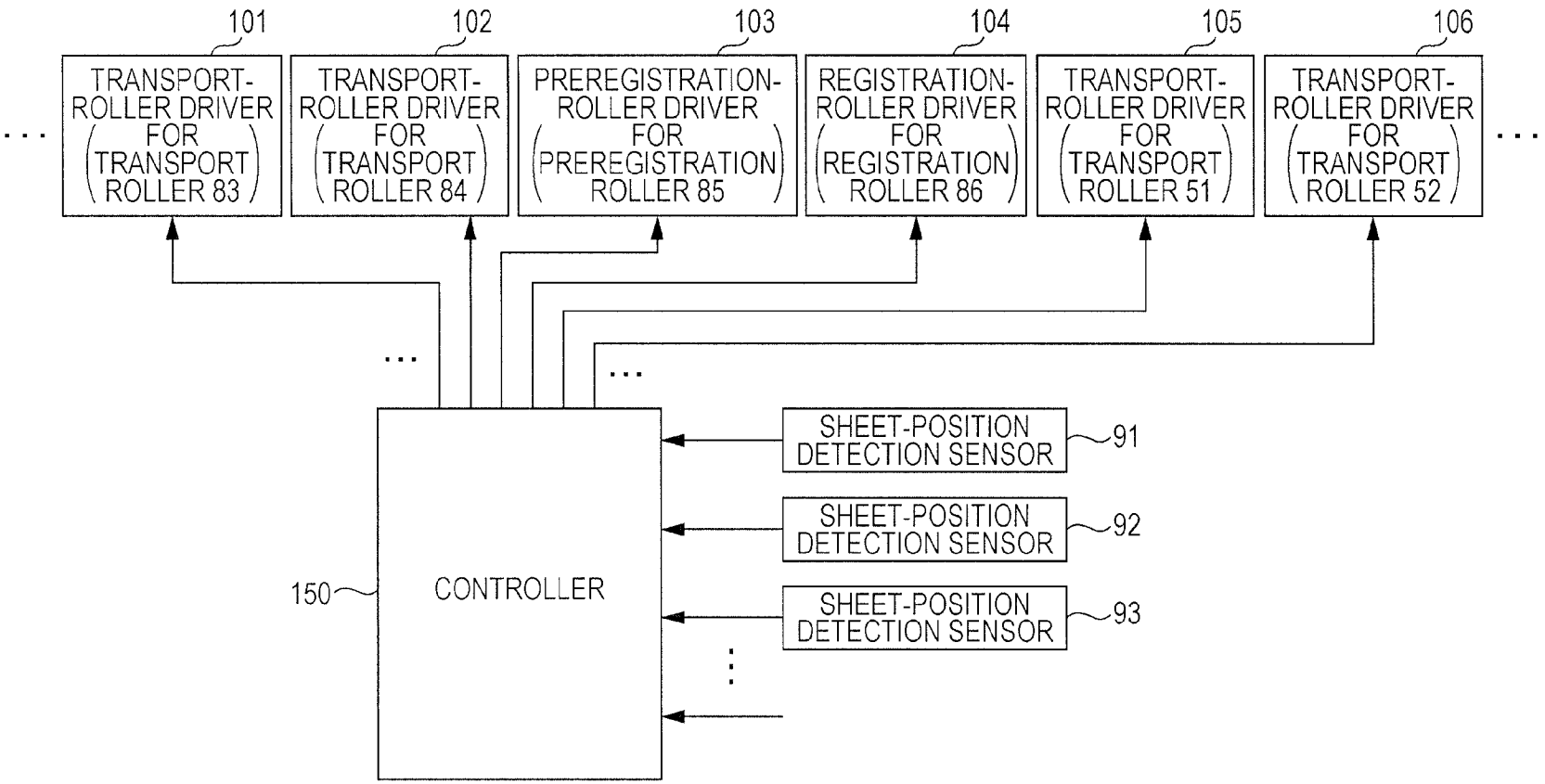
FIG. 6 illustrates the configuration for controlling the transport rollers in the large-capacity sheet feed apparatus according to the exemplary embodiment of the present invention.

Next, FIG. 6 illustrates the configuration for controlling the transport rollers in the large-capacity sheet feed apparatus 20 according to this exemplary embodiment.

As shown in FIG. 6, the large-capacity sheet feed apparatus 20 according to this exemplary embodiment is provided with a controller 150. The controller 150 receives detection signals from the sheet-position detection sensors 91 to 93 and so on to detect the position of a transported sheet, and controls transport-roller drivers 101, 102, 105, and 106, a preregistration-roller driver 103, a registration-roller driver 104, and so on based on the detected sheet position, thereby performing drive control of the various types of transport rollers.

Each of the sheet-position detection sensors 91 to 93 is capable of not only detecting whether or not a sheet has passed the position where the sensor is provided, but also detecting the position of the leading edge or the trailing edge of a current sheet based on the time elapsed since the passing of the sheet and the transport speed at that time.

In this exemplary embodiment, the controller 150 performs control as follows. Specifically, when a preset time elapses after the sheet-position detection sensor 92 detects that the leading edge of a sheet has reached the registration roller 86, the controller 150 causes the registration roller 86 to resume transporting the sheet at a transport speed of 727 mm/s. When the sheet-position detection sensor 93 detects that the leading edge of the sheet has passed the transport roller 51, the controller 150 increases the transport speed of the registration roller 86 from 727 mm/s to 1100 mm/s before the sheet reaches the transport roller 52.

Moreover, the controller 150 performs control as follows. Specifically, when the sheet-position detection sensor 92 detects that the leading edge of a sheet has reached the registration roller 86, the controller 150 causes the transport rollers 83 and 84 to stop transporting. When the registration roller 86 is caused to resume transporting the sheet at a transport speed of 727 mm/s, the controller 150 controls the transport rollers 83 and 84 to transport the sheet at a transport speed of 727 mm/s. When the sheet-position detection sensor 91 detects that the trailing edge of the transported sheet has passed the transport rollers 83 and 84, the controller 150 increases the transport speed of the transport rollers 83 and 84 from 727 mm/s to 1100 mm/s.

The following description with reference to FIGS. 7 to 14 relates to how control is performed in the large-capacity sheet feed apparatus 20 according to this exemplary embodiment when a sheet travels from the transport roller 83 to the transport roller 52.

Figure 7:
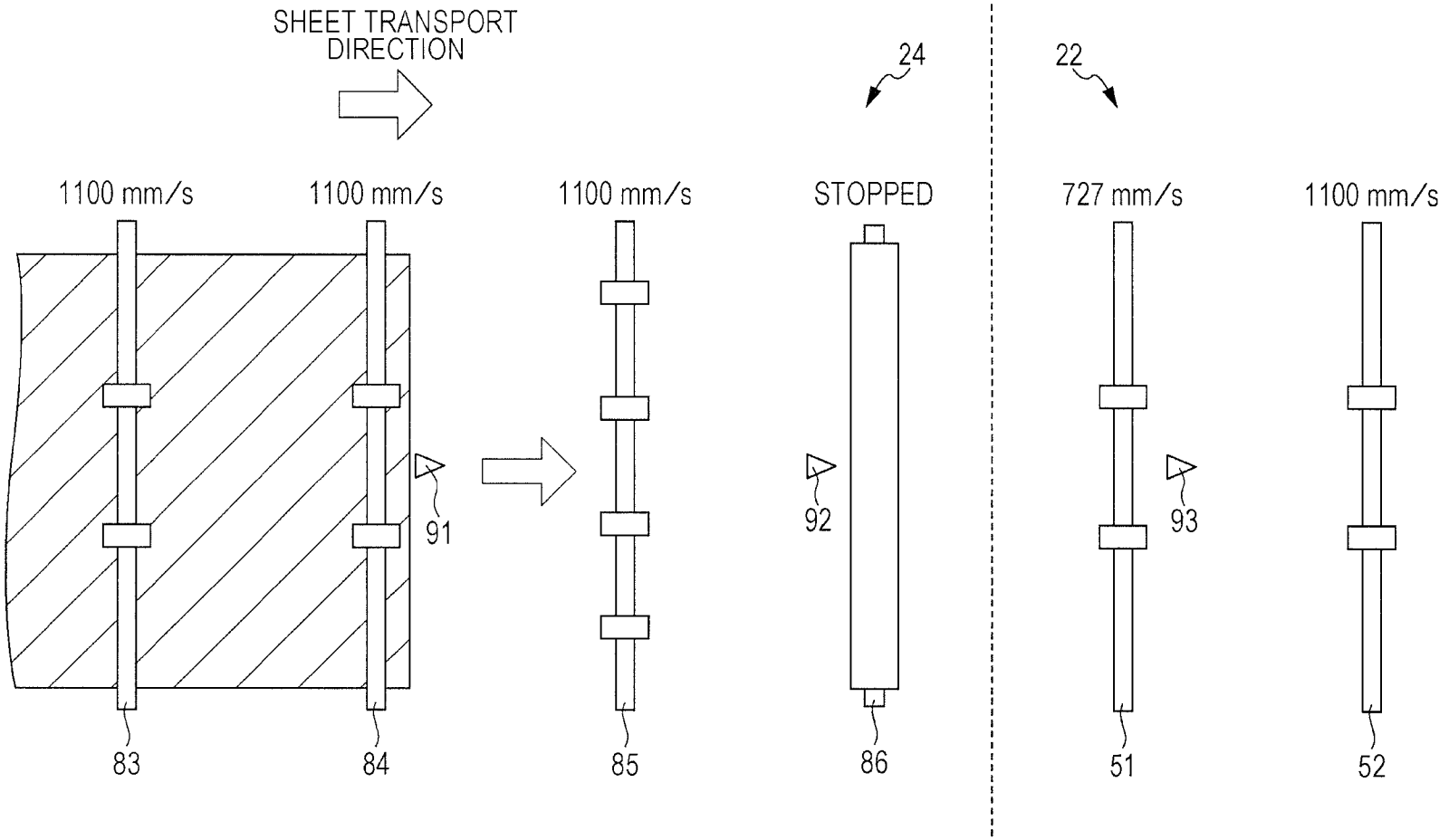
FIG. 7 illustrates control performed in the large-capacity sheet feed apparatus according to the exemplary embodiment of the present invention when a sheet travels from an upstream transport roller to a downstream transport roller.

First, as shown in FIG. 7, the transported sheet is transported at a transport speed of 1100 mm/s from the transport roller 83 to the transport roller 84.

Figure 8:
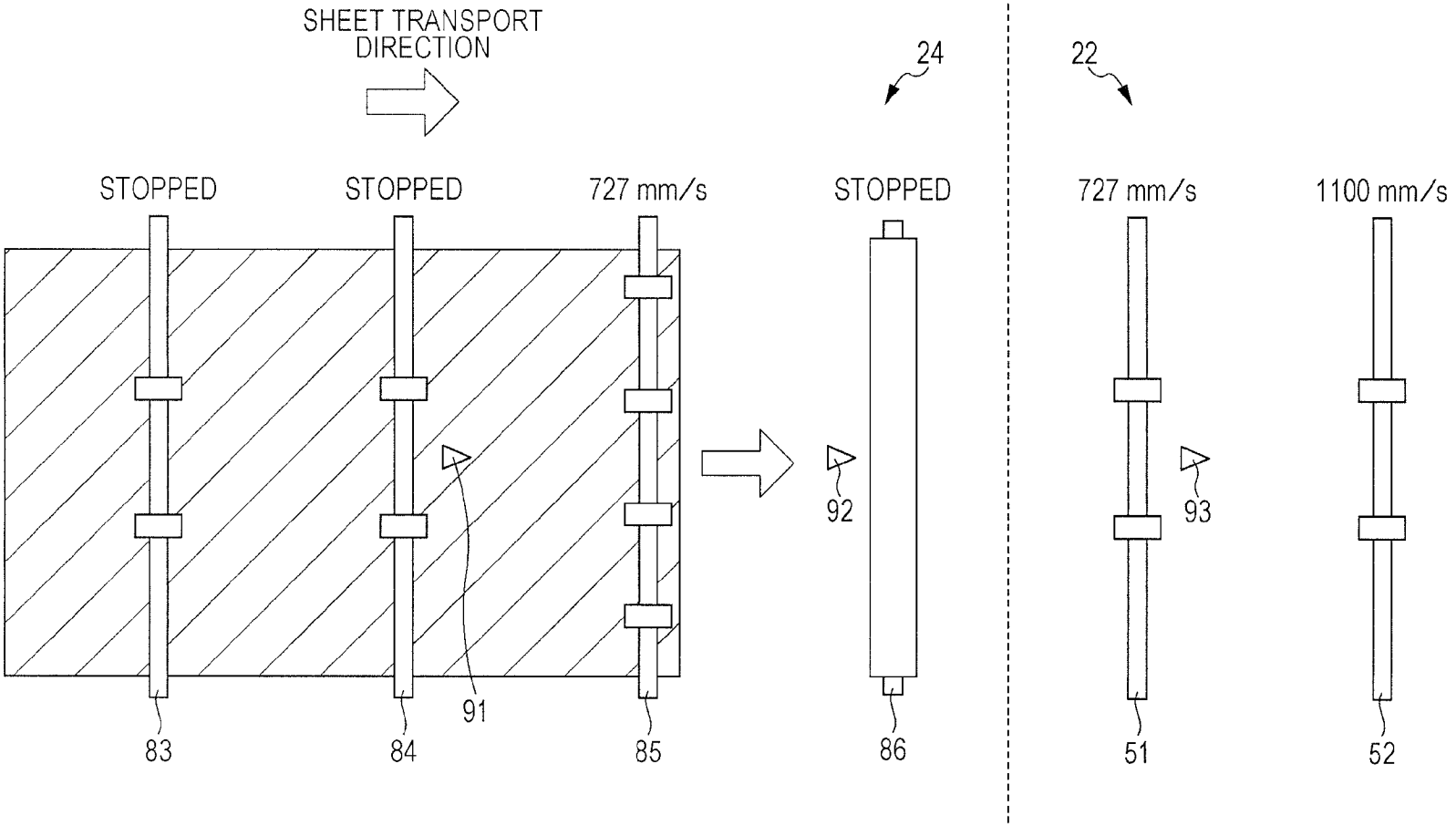
FIG. 8 illustrates control performed in the large-capacity sheet feed apparatus according to the exemplary embodiment of the present invention when the sheet travels from the upstream transport roller to the downstream transport roller.

Then, as shown in FIG. 8, when the sheet passes the sheet-position detection sensor 91 and reaches the preregistration roller 85, clutches are released in the drivers for the transport rollers 83 and 84, so that the transport rollers 83 and 84 stop transporting. Subsequently, the preregistration roller 85 decreases in speed in a stepwise fashion from 1100 mm/s to 600 mm/s and then to 300 mm/s.

Figure 9:
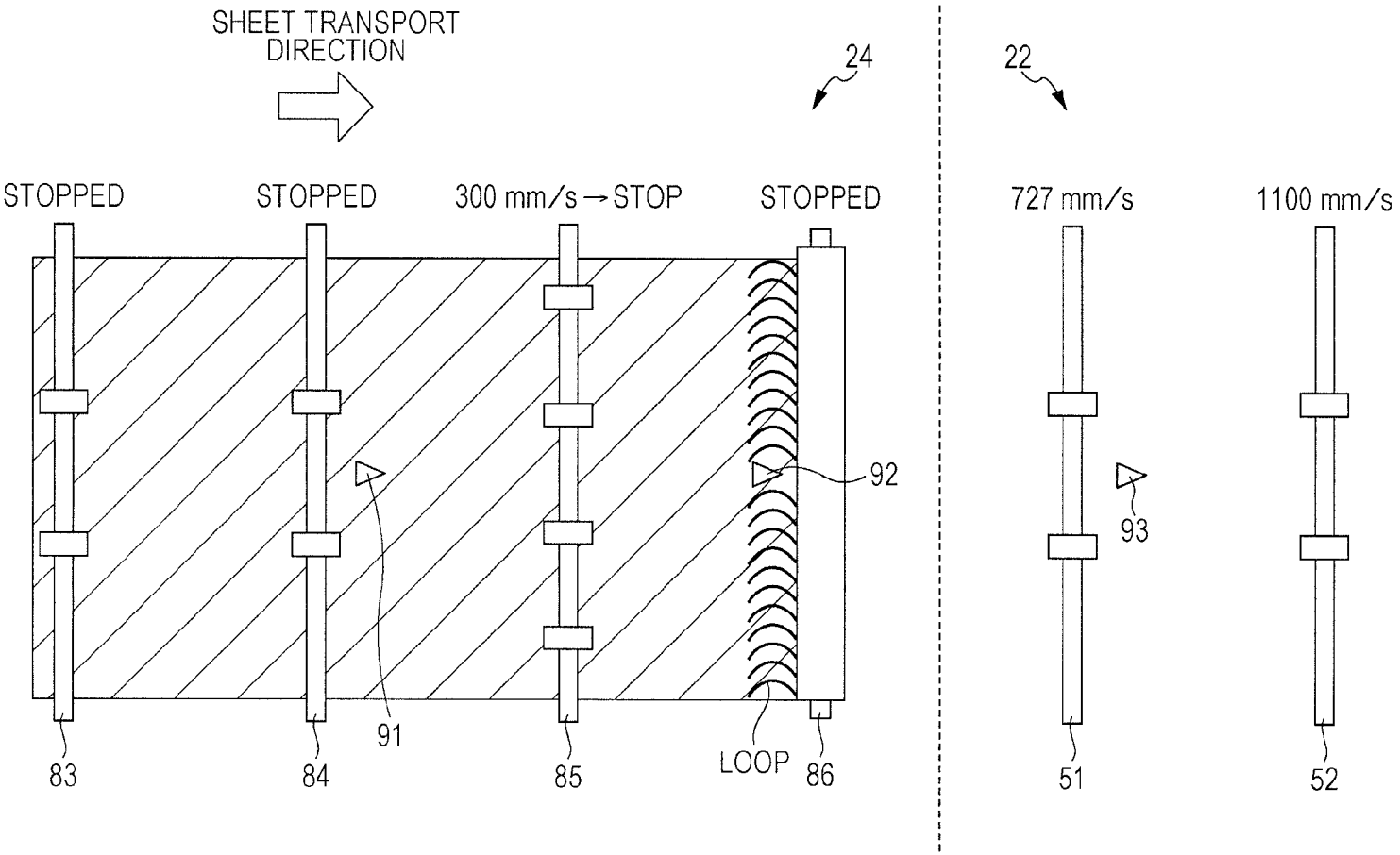
FIG. 9 illustrates control performed in the large-capacity sheet feed apparatus according to the exemplary embodiment of the present invention when the sheet travels from the upstream transport roller to the downstream transport roller.

Then, as shown in FIG. 9, when a certain time elapses after the sheet passes the sheet-position detection sensor 92, a loop is formed in the sheet as a result of the leading edge thereof reaching the registration roller 86 in a stopped state. When the loop is formed, the preregistration roller 85 becomes in a completely stopped state. In this case, the preregistration roller 85 is in an open state.

Figure 10:
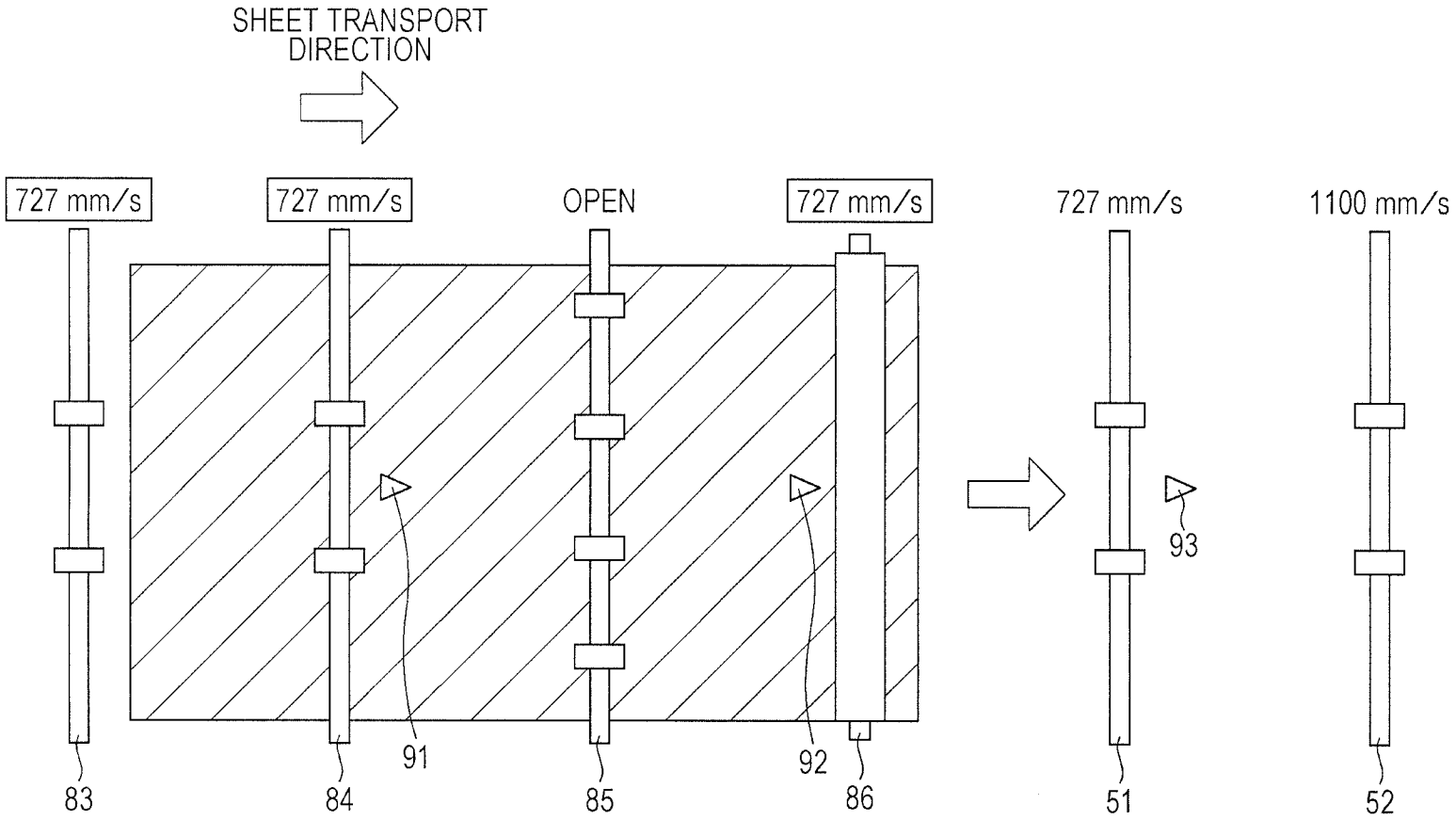
FIG. 10 illustrates control performed in the large-capacity sheet feed apparatus according to the exemplary embodiment of the present invention when the sheet travels from the upstream transport roller to the downstream transport roller.

Then, as shown in FIG. 10, the controller 150 causes the registration roller 86 to resume transporting the sheet at a transport speed of 727 mm/s. In this case, the controller 150 controls the transport rollers 83 and 84 previously in a stopped state to transport the sheet at a transport speed of 727 mm/s. In other words, the transport rollers 83 and 84 and the registration roller 86 resume the transport operation at the same transport speed.

Figure 11:
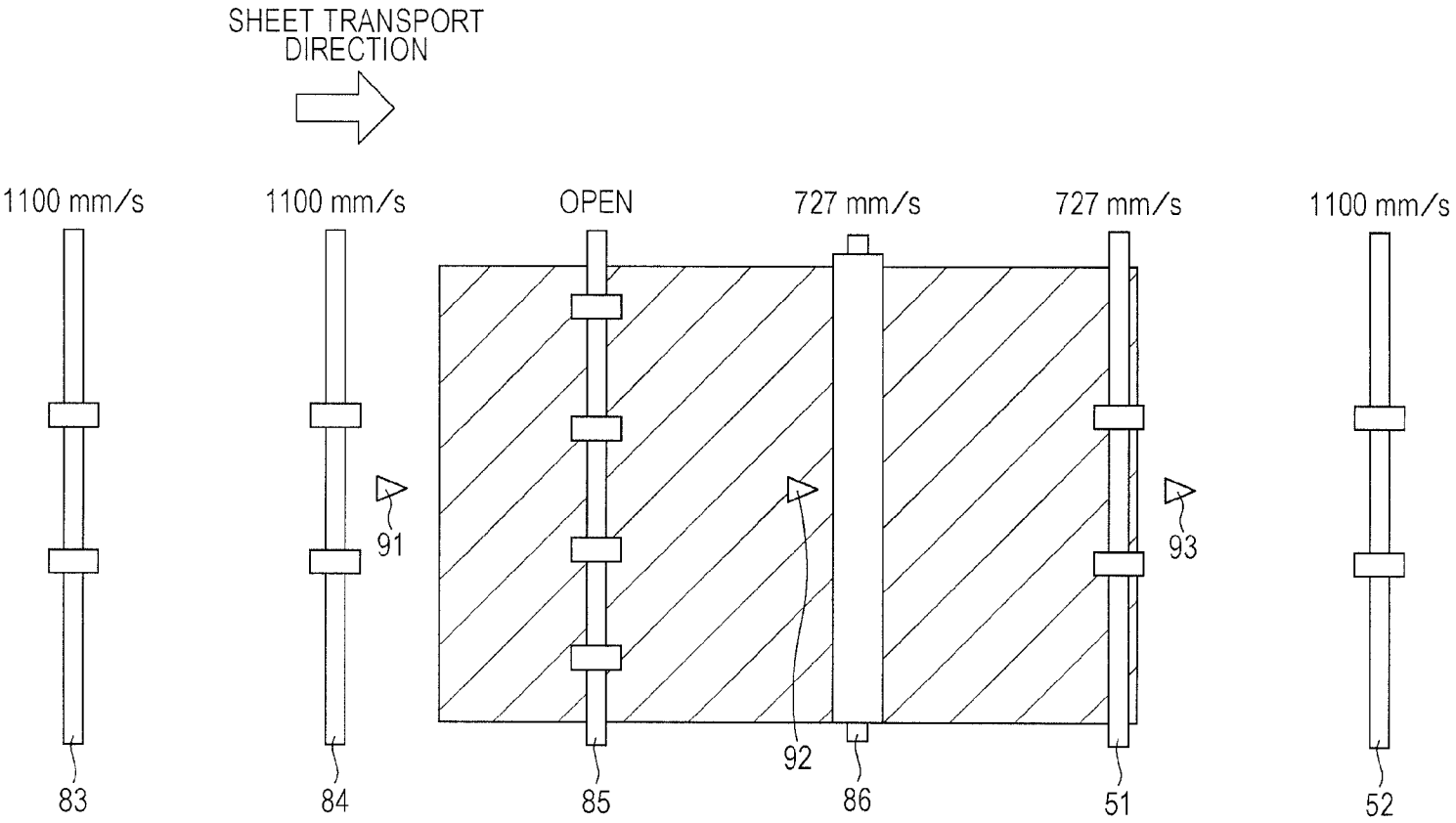
FIG. 11 illustrates control performed in the large-capacity sheet feed apparatus according to the exemplary embodiment of the present invention when the sheet travels from the upstream transport roller to the downstream transport roller.

Then, as shown in FIG. 11, when the sheet-position detection sensor 91 detects that the trailing edge of the transported sheet has passed the transport rollers 83 and 84, the controller 150 performs control to increase the transport speed of the transport rollers 83 and 84 from 727 mm/s to 1100 mm/s.

Although the sheet that has passed the registration roller 86 passes the transport roller 51, since the transport speed of the registration roller 86 and the transport speed of the transport roller 51 are both 727 mm/s at this time, the transporting of the sheet is performed without problems.

Figure 12:
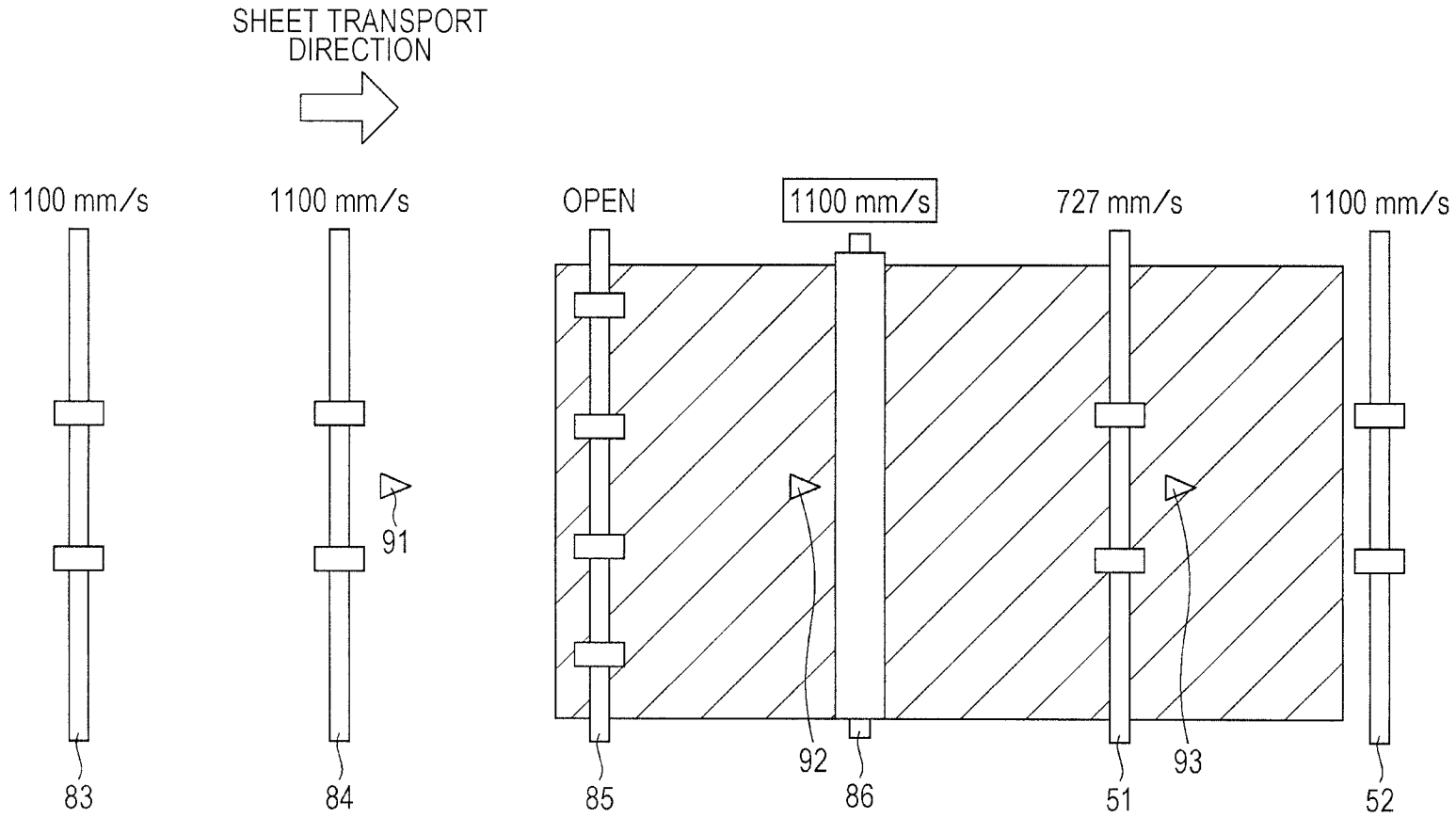
FIG. 12 illustrates control performed in the large-capacity sheet feed apparatus according to the exemplary embodiment of the present invention when the sheet travels from the upstream transport roller to the downstream transport roller.

Then, as shown in FIG. 12, when the sheet-position detection sensor 91 detects that the sheet has passed the transport roller 51, the controller 150 increases the transport speed of the registration roller 86 from 727 mm/s to 1100 mm/s before the sheet reaches the transport roller 52.

Figure 13:
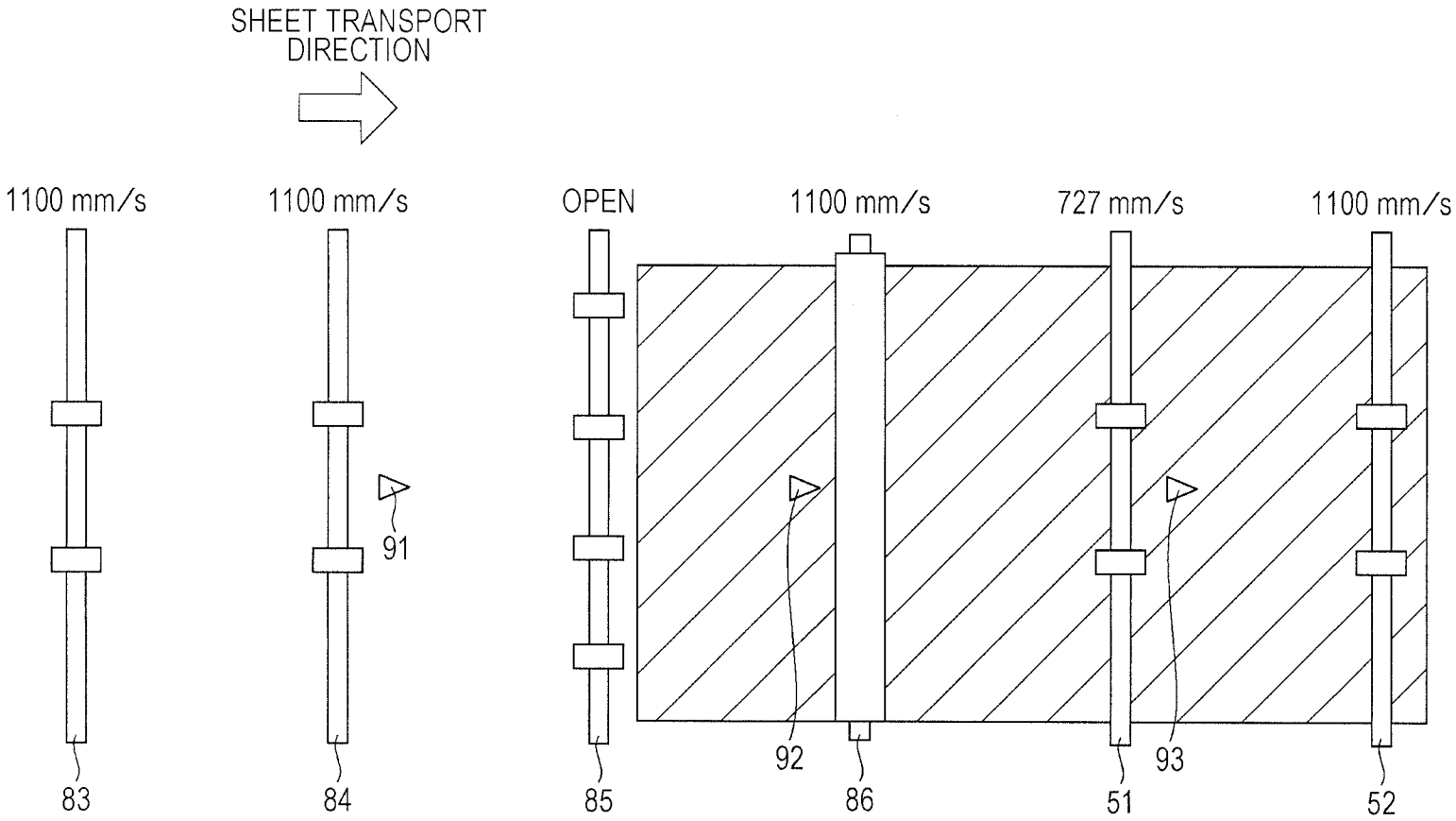
FIG. 13 illustrates control performed in the large-capacity sheet feed apparatus according to the exemplary embodiment of the present invention when the sheet travels from the upstream transport roller to the downstream transport roller.
Figure 14:
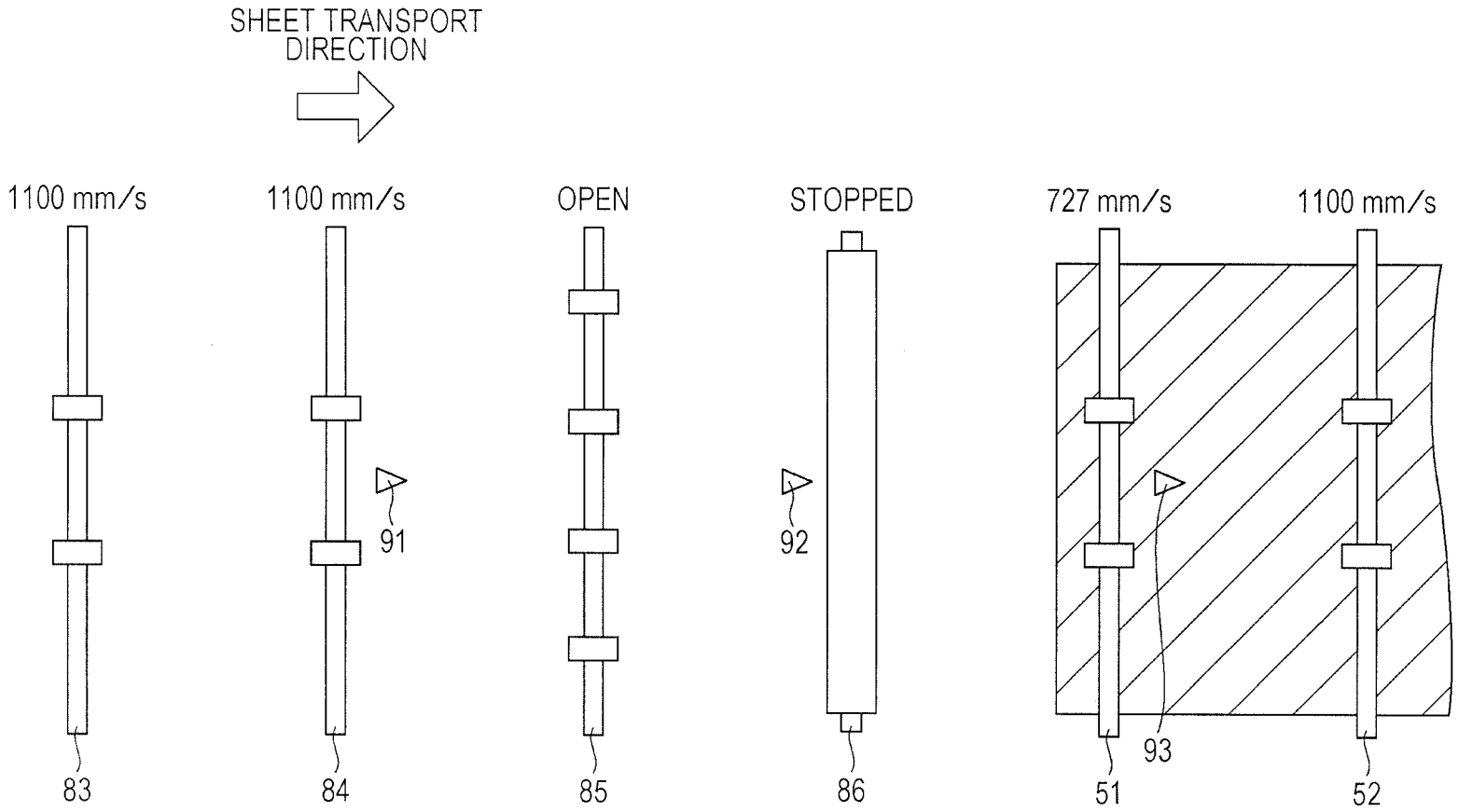
FIG. 14 illustrates control performed in the large-capacity sheet feed apparatus according to the exemplary embodiment of the present invention when the sheet travels from the upstream transport roller to the downstream transport roller.

As a result, as shown in FIG. 13, when the sheet passes the transport roller 52, since the transport speed of the transport roller 52 and the transport speed of the registration roller 86 are both 1100 mm/s, the sheet is not pulled between the transport roller 52 and the registration roller 86. Because the driver for the transport roller 51 is provided with a one-way clutch, the transport roller 51 is configured to rotate idly when the sheet is transported at a speed higher than the transport speed of the transport roller 51.

Subsequently, when the trailing edge of the sheet passes the registration roller 86, the controller 150 stops the transport operation of the registration roller 86 and prepares for a subsequent transported sheet.

Figure 15:
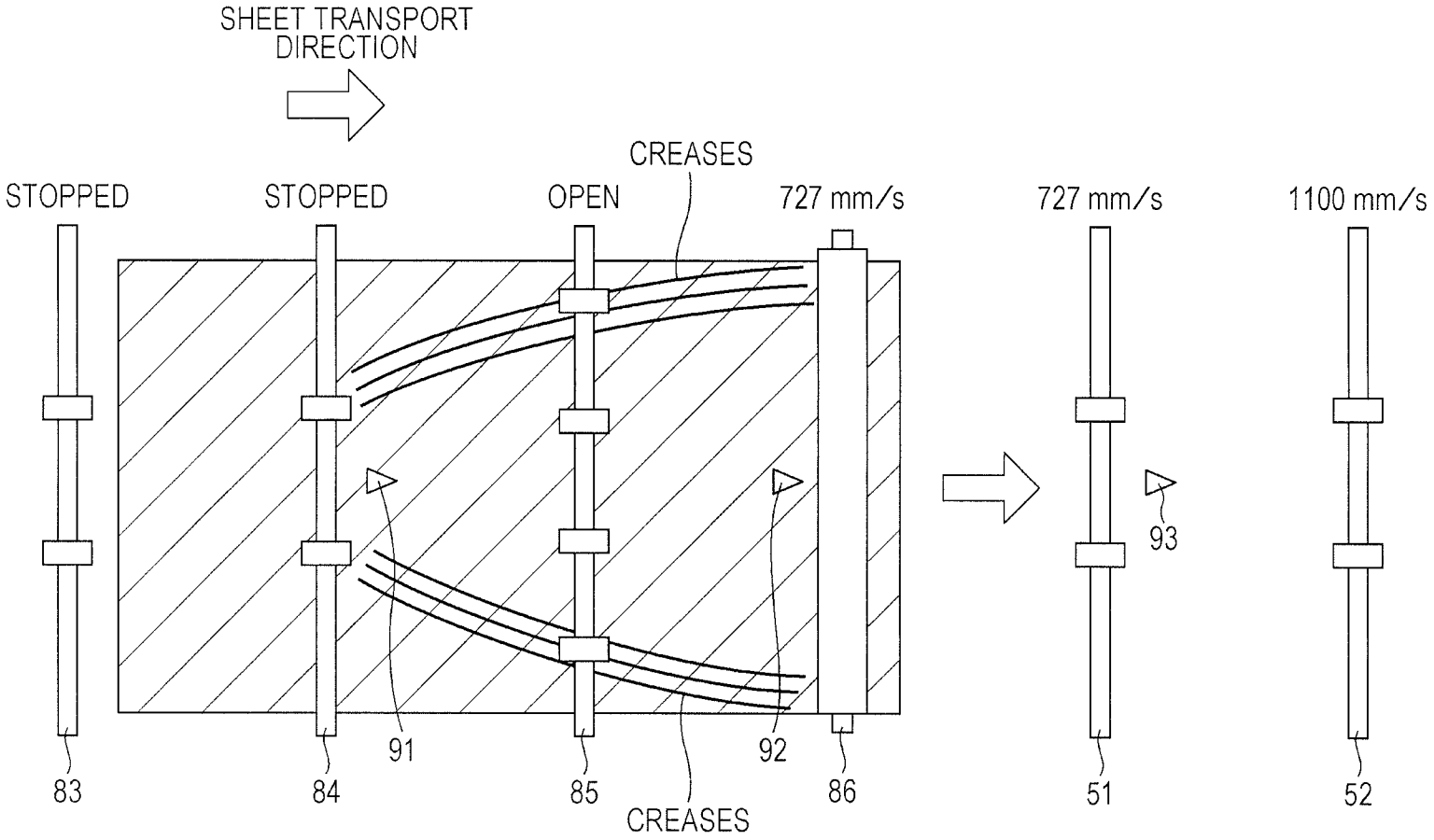
FIG. 15 illustrates a case where two upstream transport rollers are kept in a stopped state when a registration roller resumes transporting in the state in FIG. 10.

The following description with reference to FIG. 15 relates to a case where the transport rollers 83 and 84 are kept in a stopped state when the registration roller 86 resumes transporting in the above-described state in FIG. 10.

In the case of FIG. 15, when the transport rollers 83 and 84 are in a stopped state, creases are formed in the sheet, as shown in FIG. 15, due to pulling load from the transport rollers 83 and 84, regardless of the fact that the registration roller 86 is pulling the sheet at 727 mm/s.

In particular, the transport rollers 83 and 84 are each provided with two transport roller bearings near the center of the sheet, whereas the registration roller 86 is configured to pull the entire sheet. Thus, as shown in FIG. 15, creases are formed, starting from an area where the sheet is retained by the transport rollers 83 and 84.

If the transport rollers 83 and 84 are driven at 1100 mm/s when the registration roller 86 resumes transporting, a pushing force is generated from the trailing edge due to a speed difference relative to the registration roller 86. In this case, creases are similarly formed in the transported sheet.

Figure 16:
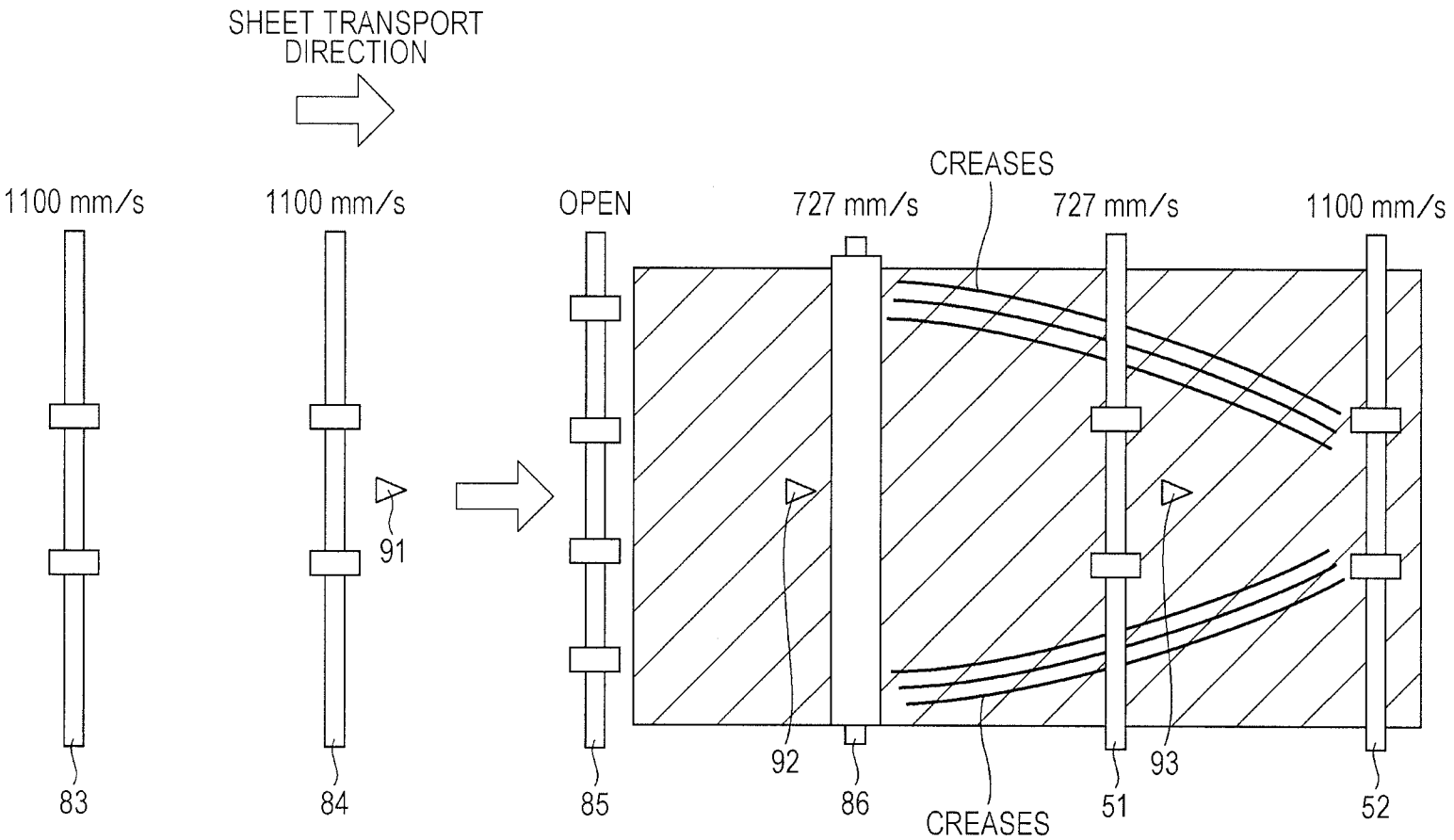
FIG. 16 illustrates a case where the transport speed of the registration roller is maintained at 727 mm/s when the sheet reaches the downstream transport roller in the state in FIG. 12.

The following description with reference to FIG. 16 relates to a case where the transport speed of the registration roller 86 is kept at 727 mm/s when the sheet reaches the transport roller 52 in the above-described state in FIG. 12.

In the case of FIG. 16, the transport roller 52 pulls the sheet at a transport speed of 1100 mm/s, whereas the registration roller 86 feeds the sheet at only 727 mm/s. Thus, the sheet is pulled from opposite directions by the registration roller 86 and the transport roller 52 due to a transport-speed difference therebetween, thereby forming creases in the sheet, as shown in FIG. 16.

In particular, the transport roller 52 is provided with two transport roller bearings near the center of the sheet, whereas the registration roller 86 is configured to pull the entire sheet. Thus, as shown in FIG. 16, creases are formed, starting from an area where the sheet is retained by the transport roller 52.

Modification

The description of the above exemplary embodiment relates to a case where the transport speed of the transport roller 51 is lower than that of the remaining transport rollers in the flat transport unit 24 of the large-capacity sheet feed apparatus 20. However, the exemplary embodiment of the present invention is not limited to this case and may be similarly applied to a sheet transport device in which the transport speed of one or more transport rollers of the multiple transport rollers is lower than that of the remaining transport roller or rollers.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

a first rotating member configured to transport a sheet at a first transport speed;

a second rotating member that is provided upstream of the first rotating member in a sheet transport direction and that is configured to transport the sheet at a second transport speed, which is lower than the first transport speed;

a third rotating member that is provided upstream of the second rotating member in the sheet transport direction, wherein the third rotating member is configured to, in a stopped state, receive the transported sheet and subsequently transport the sheet so as to perform positional correction on the sheet;

first and second sheet position detectors that are configured to detect positions of a leading edge of the transported sheet; and a controller configured to control such that, if a preset time elapses after the first sheet position detector detects that the leading edge of the sheet has reached the third rotating member, then the third rotating member is caused to transport the sheet at the second transport speed, and if the second sheet position detector detects that the leading edge of the sheet has passed the second rotating member, then the third rotating member is increased in transport speed from the second transport speed to the first transport speed.

2. The sheet transport device according to claim 1, wherein the third rotating member is configured to come into contact with the transported sheet continuously in a sheet width direction, and wherein the first rotating member is configured to only partially come into contact with the transported sheet in the sheet width direction.

3. The sheet transport device according to claim 1, wherein an area that the third rotating member comes into contact with the transported sheet in a sheet width direction is larger than an area that the first rotating member comes into contact with the transported sheet in the sheet width direction.

4. The sheet transport device according to claim 1, further comprising:

a fourth rotating member that is provided upstream of the third rotating member in the sheet transport direction and that is configured to transport the sheet at the first transport speed; and a third sheet position detector configured to detect a position of a trailing edge of the transported sheet, wherein the controller is configured to control such that, if the first sheet position detector detects that the leading edge of the sheet has reached the third rotating member, then the fourth rotating member is caused to stop transporting, and if the third rotating member is caused to transport the sheet at the second transport speed, then the fourth rotating member is controlled to transport the sheet at the second transport speed, and wherein, if the third sheet position detector detects that the trailing edge of the transported sheet has passed the fourth rotating member, then the fourth rotating member is increased in transport speed from the second transport speed to the first transport speed.

5. The sheet transport device according to claim 4, wherein the third rotating member is configured to come into contact with the transported sheet continuously in a sheet width direction, and wherein the fourth rotating member is configured to only partially come into contact with the transported sheet in the sheet width direction.

6. The sheet transport device according to claim 4, wherein an area that the third rotating member comes into contact with the transported sheet in a sheet width direction is larger than an area that the fourth rotating member comes into contact with the transported sheet in the sheet width direction.

7. An image forming system comprising:

a sheet transport device including:

a first rotating member configured to transport a sheet at a first transport speed;

a second rotating member that is provided upstream of the first rotating member in a sheet transport direction and that is configured to transport the sheet at a second transport speed, which is lower than the first transport speed;

a third rotating member that is provided upstream of the second rotating member in the sheet transport direction, wherein the third rotating member is configured to, in a stopped state, receive the transported sheet and subsequently transport the sheet so as to perform positional correction on the sheet;

first and second sheet position detectors that are configured to detect positions of a leading edge of the transported sheet; and a controller configured to control such that, if a preset time elapses after the first sheet position detector detects that the leading edge of the sheet has reached the third rotating member, then the third rotating member is caused to transport the sheet at the second transport speed, and if the second sheet position detector detects that the leading edge of the sheet has passed the second rotating member, then the third rotating member is increased in transport speed from the second transport speed to the first transport speed; and an image forming apparatus configured to form an image onto the sheet transported by the sheet transport device.

8. The image forming system according to claim 7, wherein the sheet transport device further includes:

a fourth rotating member that is provided upstream of the third rotating member in the sheet transport direction and that is configured to transport the sheet at the first transport speed; and a third sheet position detector configured to detect a position of a trailing edge of the transported sheet, and wherein the controller is configured to control such that, if the first sheet position detector detects that the leading edge of the sheet has reached the third rotating member, then the fourth rotating member is caused to stop transporting, and if the third rotating member is caused to transport the sheet at the second transport speed, then the fourth rotating member is controlled to transport the sheet at the second transport speed, and wherein, if the third sheet position detector detects that the trailing edge of the transported sheet has passed the fourth rotating member, then the fourth rotating member is increased in transport speed from the second transport speed to the first transport speed.

* * * * *